United States Patent [19]

Irwin et al.

[11] Patent Number: 4,520,581

[45] Date of Patent: Jun. 4, 1985

[54] CUSTOM FOOTBED SUPPORT AND METHOD AND APPARATUS FOR MANUFACTURING SAME

[75] Inventors: J. Michael Irwin, 7730 B, SW. Spruce St., Tigard, Oreg. 97223; Jay P. White, Tigard, Oreg.

[73] Assignee: J. Michael Irwin, Portland, Oreg.

[21] Appl. No.: 335,645

[22] Filed: Dec. 30, 1981

[51] Int. Cl.[3] ..... A43B 13/38; A43B 19/00; A61F 5/14

[52] U.S. Cl. ..... 36/88; 36/44; 36/93; 36/71; 128/595; 128/619; 128/622; 12/142 N; 12/146 M

[58] Field of Search ..... 36/44, 30 R, 88, 93, 36/71; 128/581, 586, 595, 596, 619, 621, 622, 89, 90; 12/142 N, 146 M, 146 L

[56] References Cited

U.S. PATENT DOCUMENTS

| | | | |
|---|---|---|---|
| 3,320,347 | 5/1967 | Greenawalt | 128/595 |
| 3,683,903 | 8/1972 | Fox et al. | 128/90 |
| 4,043,327 | 8/1977 | Potter et al. | 128/90 |

FOREIGN PATENT DOCUMENTS

| | | | |
|---|---|---|---|
| 0026897 | 10/1979 | European Pat. Off. | 36/93 |
| 3009247 | 9/1981 | Fed. Rep. of Germany | 128/581 |

*Primary Examiner*—Werner H. Schroeder

*Assistant Examiner*—Steven N. Meyers

*Attorney, Agent, or Firm*—Klarquist, Sparkman, Campbell, Leigh & Whinston

[57] ABSTRACT

A footbed support for footwear comprises a laminate footbed custom formed to the shape of the wearer's foot from laminae of water-activated, polyurethane-impregnated fabric sheet material. The footbed is formed by placing the water-activated lamina on a resilient domed foot pad, then placing the foot in a predetermined position on the pad over the laminae so that the longitudinal arch of the foot overlies a portion of the dome corresponding to the height of the longitudinal arch and shape of the sole of the foot. The foot is then weighted to form an impression in the laminate, and the laminate allowed to partially cure before the foot is removed. Before final placement of the foot on the pad, the laminae are cut to differential lengths and widths if desired to provide a desired differential flexibility, rigidity, and thickness in different areas of the cured laminate footbed. An apparatus for forming the footbed includes a tray divided into two laterally separable sections, each containing a domed section of the resilient foot pad. Each of the pad sections is indexed by color-coded zones on the domed portion and by index pointers as an aid to foot positioning according to preliminary foot classification.

23 Claims, 11 Drawing Figures

FIG. 1
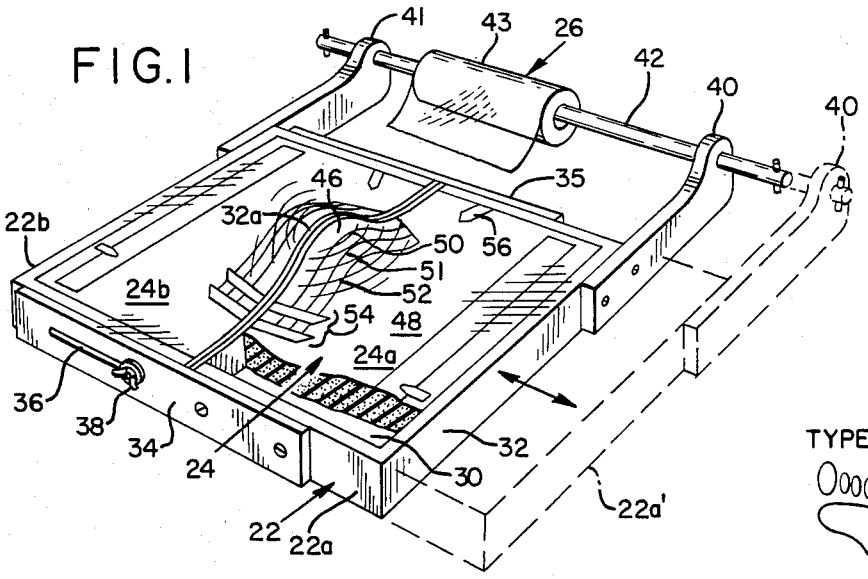
FIG. 2
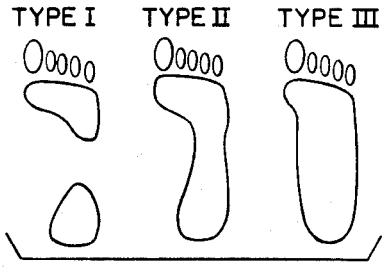
FIG. 4
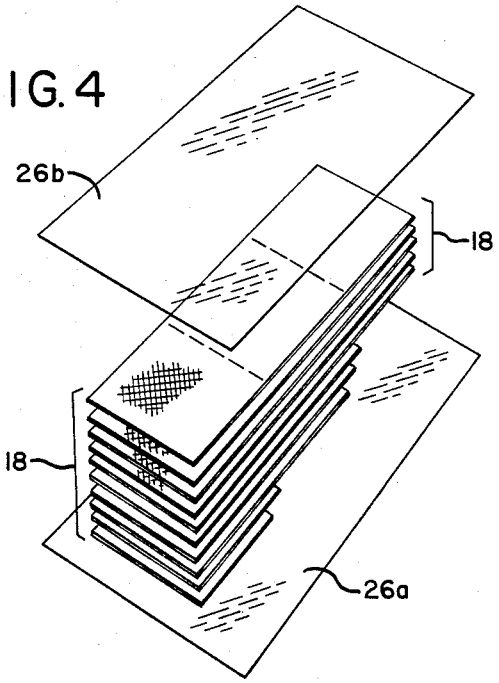
FIG. 5
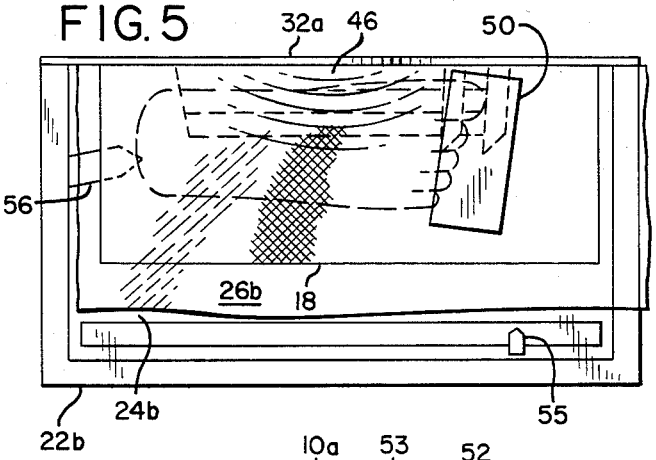
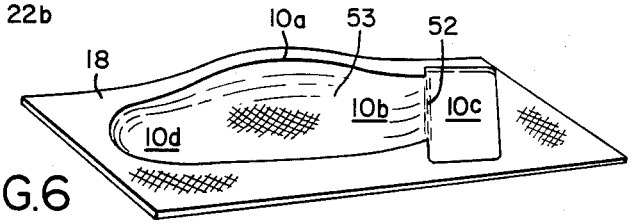
FIG. 6
FIG. 8
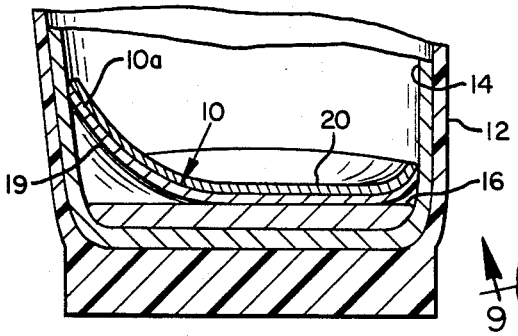
FIG. 7
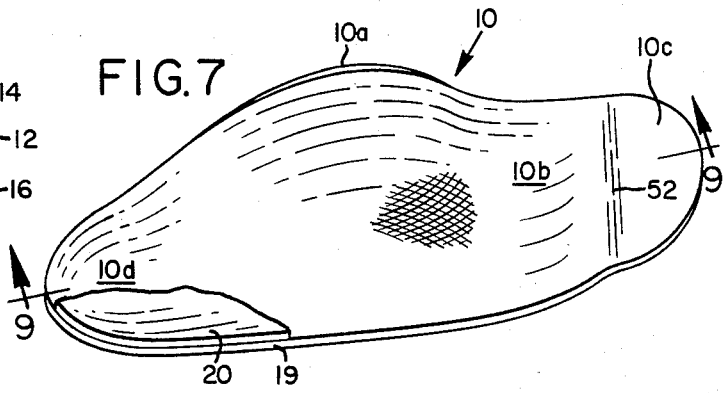

FIG. 3
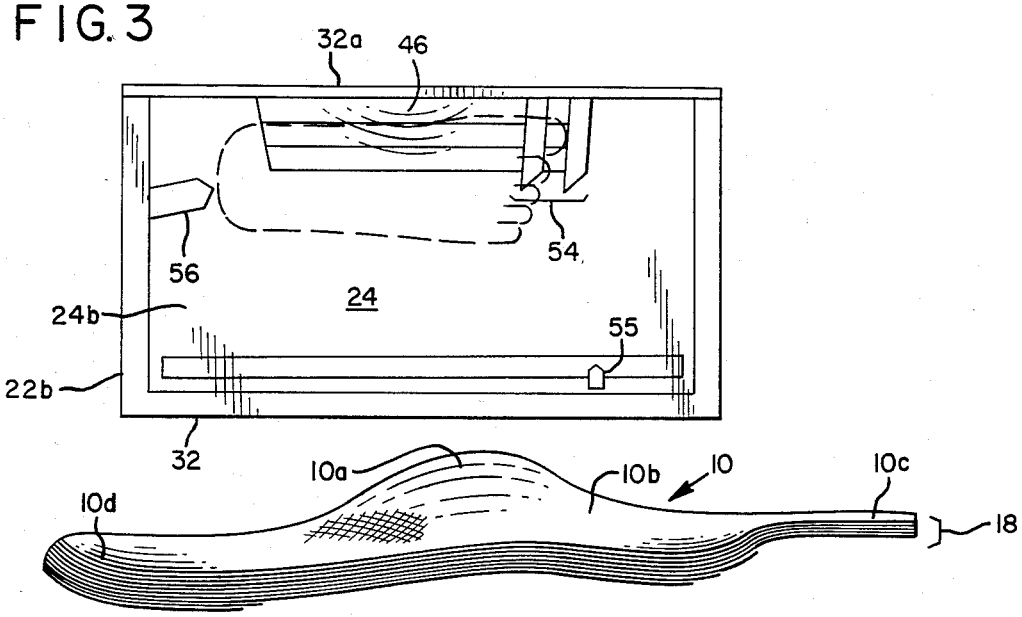
FIG. 9
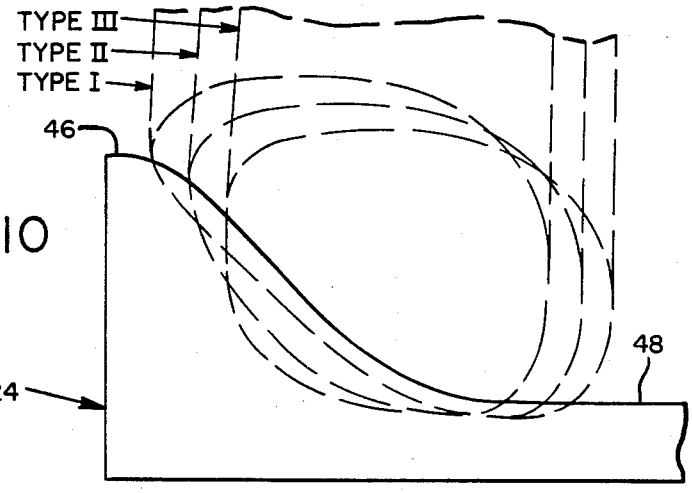
FIG. 10
FIG. 11
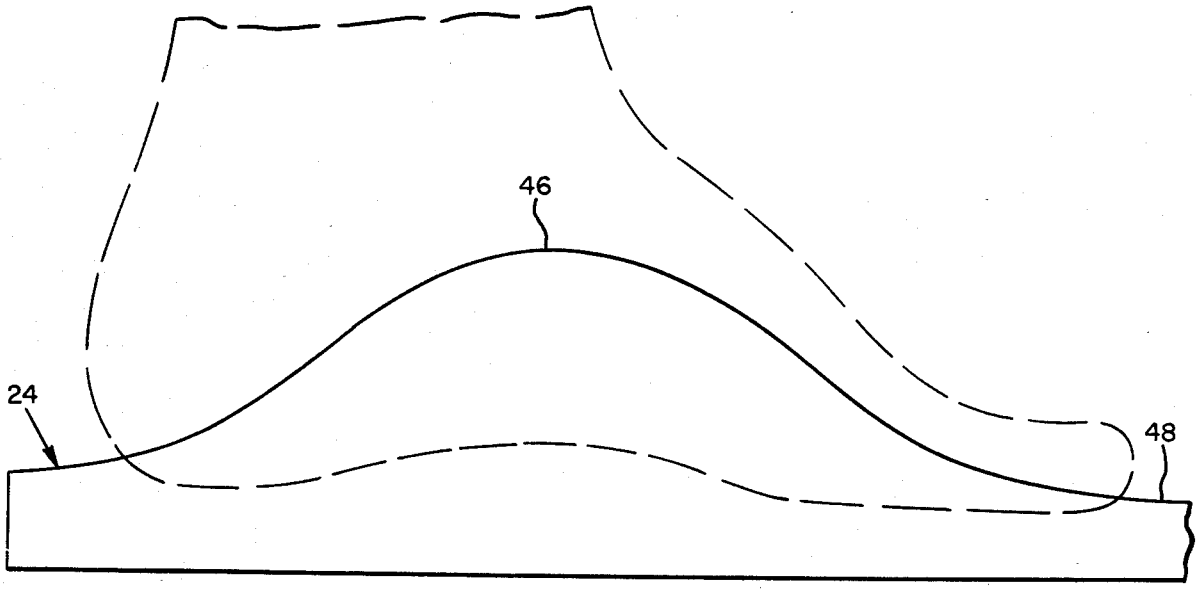

CUSTOM FOOTBED SUPPORT AND METHOD AND APPARATUS FOR MANUFACTURING SAME

BACKGROUND OF THE INVENTION

1. Field of the Invention

The present invention relates to footbed supports for supporting feet in desired positions in boots or shoes and to a method and apparatus for manufacturing such footbed supports. The invention relates more particularly to such footbed supports which are custom shaped and fitted for particular feet.

2. Description of the Prior Art

Various types of innersoles for shoes and boots are well known. The typical innersole is flat and either lined or unlined and of various thicknesses to provide either cushioning, warmth or an improved fit. Such conventional innersoles do not provide any foot support other than that provided by the innersole of the shoe or boot itself.

There are also custom footbed supports, called orthotics, manufactured and fitted by podiatrists to correct certain foot problems and abnormalities. Typically such supports are made in a three-step process involving the making of negative and positive plaster casts of the foot, and the formation of the support from the positive cast using a rigid thermoplastic material. They are very expensive. Also such special supports provide no control of the flexibility of the footbed or different portions thereof, and are not adapted for special purposes such as skiing to provide a correct foot-boot-ski relationship for improved edge control.

Within the last few years another type of innersole has appeared on the market in the United States under the tradename "Conform'able" marketed by Sidas of Grenoble, France. The Conform'able innersoles are made of a thermoplastic material. The relatively thin plastic sheet material is placed, while in a heated, pliable condition, on a resilient domed foam pad supported on a flat surface. The feet are placed on the plastic sheets while the person assumes a normal stance. The feet are positioned so that their insteps or longitudinal arches extend along the domed portion of the pad, but without taking into account the height or length of the longitudinal arch, or overall shape of the foot.

Additional pressure is applied to the plastic innersole sheets to form foot impressions in the sheets by having the wearer apply upward pulling force to handlebars attached to the platform on which the wearer stands. The plastic material is allowed to cool and set, after which the feet are removed from the material. The resulting innersoles are trimmed to conform to the shoe or boot and placed inside.

The Conform'able innersoles as described have several disadvantages as follows:

First they provide very little foot support because they are relatively thin and flexible, tending to flatten out when weighted in a shoe or boot.

Second, they are heat destructible, such as when placed inadvertently on a back window ledge of an automobile or too close to a stove or fireplace.

Third, they are provided in one uniform thickness and flex which cannot be varied for different applications and foot conditions.

Fourth, the flexibility of different portions of the innersole cannot be varied to provide different degrees of support for different portions of the foot as needed.

Fifth, they do not provide any correction of foot position within a shoe or boot to improve performance, such as in a ski boot to improve edge control.

Sixth, they are not manufactured or wedged to take into account different foot shapes, structures and abnormalities such as pronation, valgus, varus, supination, etc.

Seventh, they are made with all pairs of feet in the same foot position on the domed pads and with the same spread between feet. Thus, they do not take into account variations in natural stance, body size, ankle-knee-hip alignment, longitudinal arch height, and other differences in feet among different persons.

Eighth, they do not readily accommodate other corrective foot aids such as varus wedges and pads, either during or after their manufacture.

Because of the foregoing deficiencies of the Conform'able innersoles, they function only as another innersole and not as a corrective foot support.

When skiing, for example, it is important for proper edge control that the skis lie flat against the snow and parallel to one another when the skier assumes a natural stance and foot position in the ski boots. However, if a skier's feet toe-out or toe-in abnormally, or support the body weight to an abnormal degree on the outsides or insides of the feet when in the usual ski boots, these abnormalities will be transmitted through the boots to the skis, resulting in the skis being edged or assuming a skewed relationship when they should be flat and parallel on the snow surface. Also, if a skier has a high instep or longitudinal arch, tightening of the ski boot tends to flatten the foot against the normally flat insole of the ski boot, causing great pain and a loss of the ability to properly control the ski edges. Similarly, if a skier's foot can rock from side-to-side within the inner ski boot, the skier will not have good edge control of the ski. All of these conditions, however, can be corrected with a properly designed footbed support which is custom sized and shaped for an individual's feet and which will accommodate corrective aids when necessary. However, heretofore known footbed supports do not have these capabilities.

SUMMARY OF THE INVENTION

It is therefore a primary objective of the present invention to provide a custom footbed support and a method and apparatus for manufacturing the same which will overcome all of the aforementioned deficiencies and have all of the aforementioned capabilities desired in a footbed support.

Another primary object of the invention is to provide a footbed support which is relatively indestructible.

Another primary object is to provide a footbed support which actually supports the foot in a desired, corrected position within a shoe or boot.

Another major object is to provide a footbed support which has variations in flexibility-rigidity in different areas of the footbed to meet the needs of the individual foot and application of the footbed.

Another important object is to provide a footbed support the thickness of which can be varied to provide the desired fit for a foot within a shoe or boot.

Another major object is to provide an improved method and apparatus for manufacturing the aforesaid footbed support.

Another object is to provide a method and apparatus as aforesaid which are relatively simple for nonprofessionals to use after a short training period.

A more specific object is to provide a method of manufacturing an effective footbed support directly from the user's foot, without any intermediate casting steps. This enables correction of any foot or footbed problems at the time of manufacture.

Another object is to provide a footbed support which can be made relatively inexpensively and quickly compared to footbed supports provided by professional foot specialists.

In accordance with one aspect of the invention, a footbed support for a shoe or boot comprises at least one lamina, and preferably multiple laminae of a cured, liquid-activated, plastic-impregnated casting material bearing an impression of the wearer's foot made while the material is foot-weighted in an uncured, flexible, activated condition, and while the feet are in neutral positions.

According to another aspect of the invention, the number of laminae in the footbed support may be varied in different areas of the footbed to provide various degrees of strength, rigidity, or flexibility as desired, or various thicknesses for a proper fit.

According to another aspect of the invention, the casting material of the footbed support may comprise a water-activated, polyurethane-impregnated fabric, and such fabric may be an open weave or a closed weave material. Furthermore, the fabric may comprise a cotton-polyester blend, or a fiberglass fabric.

According to another aspect of the invention, the footbed support may be manufactured by positioning a single lamina or multiple laminae of the liquid-activated, plastic-impregnated fabric, while in an activated but flexible uncured condition, over a domed portion of a resilient foot pad. The wearer's foot may then be placed on the material with the longitudinal arch of the foot positioned on a side portion of a domed portion of the pad corresponding to the shape of the longitudinal arch, with the toe and heel portions of the foot overlying the material on flatter portions of the pad. Weight is applied to the foot to bond the laminae together and form a foot impression in the material while the foot is in a desired neutral position. The foot remains on the pad until the material is at least partially cured. Then the foot is removed from the material so that the material retains an impression of the foot. The material is finally trimmed around the impression to fit within the user's shoe or boot.

According to another aspect of the method of the invention, the material on the domed pad may be covered with a thin flexible plastic cover sheet before the user's foot is placed on the material to form the impression.

According to another aspect of the invention, the user's foot may be prepositioned on the pad before the casting material is placed on the pad to determine proper foot position according to prior classification of the foot by imprint characteristics. The foot position is then marked according to index markers on the pad so that it can be removed from the pad and later replaced on the pad over the casting material in the same position.

According to another aspect of the invention, the casting material may be placed on the pad before being activated and then the various laminae may be trimmed for length and width to provide the number of laminae and thus flexibility or thickness desired in different portions of the final footbed.

According to another aspect of the method of manufacture, the cured footbed may be ground to final size and thickness to adjust its fit within the shoe or boot and its desired flexibility or rigidity in its various portions.

According to another aspect of the method of manufacture, the spacing between feet on the pad is adjusted according to the user's natural stance or to correct for any misalignment of ankles, knees and hips.

According to another aspect of the invention, the apparatus used in manufacturing the footbed support may include a tray, a resilient foam foot pad which fits snugly within the tray, with the pad including a central domed portion which merges progressively with surrounding flatter pad portions.

According to another aspect of the invention, the tray may be divided into laterally separable and adjustable sections. The foot pad may be similarly divided through its domed portion, so that each half section of the pad includes one-half of the domed portion. Each dome half is positioned adjacent to the other in their respective sections of the tray.

According to another aspect of the apparatus, the foot pad may include color-coded zones marked on the domed portion of the pad to indicate the proper positioning of the longitudinal arch of the foot on the domed portion of the pad according to the height of the longitudinal arch. The pad may also include additional indexing markers in the form of pointers for predetermining a desired foot position on the pad longitudinally of the domed portion.

According to another aspect of the invention, the tray may include plastic roll support means for supporting a roll of plastic cover sheet material to facilitate its use as a cover for the pad and casting material prior to placement of the foot on the pad. The tray may also include a slide means for facilitating the lateral separation and spacing of the tray sections while maintaining such sections in lateral alignment, together with locking means for selectively locking the tray sections in a predetermined adjusted spacing.

The foregoing and other objects, features, and advantages of the present invention will become more apparent from the following detailed description which proceeds with reference to the accompanying drawing.

BRIEF DESCRIPTION OF THE DRAWINGS

In the drawings:

FIG. 1 is a perspective view of the apparatus of the invention, including separable tray and domed foot pad sections;

FIG. 2 is a diagram illustrating the three general classifications of foot prints used in determining proper foot position on the foot pad portion of the apparatus in making the footbed support;

FIG. 3 is a plan view of one half-section of the tray and pad portion of the apparatus of FIG. 1;

FIG. 4 is an exploded schematic perspective view of the various materials and their order of placement on the foot pad in carrying out the method of the present invention.

FIG. 5 is a schematic plan view of one tray section of the apparatus of FIG. 1 showing the step in the method of manufacturing a footbed support.

FIG. 6 shows another step in the formation of a footbed support in accordance with the invention;

FIG. 7 is a perspective view of a finished footbed support in accordance with the invention;

FIG. 8 is a schematic view through a lower portion of a ski boot showing a footbed support positioned within such boot;

FIG. 9 is a longitudinal sectional view taken along the line 9—9 of FIG. 7 with an exaggerated vertical scale to show the various numbers of laminae typically provided in different portions of the footbed;

FIG. 10 is a schematic lateral sectional view taken through the domed portion of one section of the foot pad illustrating placement of feet on the pad; and FIG. 11 is a schematic side elevational view of the domed portion of section of the foot pad illustrating placement of a foot on such pad.

DETAILED DESCRIPTION OF A PREFERRED EMBODIMENT

Footbed Support Product

Referring first to FIG. 7, a footbed support 10 in accordance with the invention is contoured to provide an impression of the wearer's foot and to provide support for such foot in a desired position within the shoe or boot, such as the ski boot of FIG. 8. Such ski boot includes the typical inner boot 14 having the usual flat innersole 16 which supports the footbed support 10. The lateral inner margin of the arch 10*a* of the footbed support extends along the inside of the inner boot to provide support for the longitudinal arch of the foot which is not normally supported by innersole 16.

In addition to arch portion 10*a*, the footbed includes a fore portion 10*b* for supporting the ball of the foot, a slightly elevated "ledge" portion 10 which supports the toes, and a hind or heel portion 10*d* for supporting the heel of the foot.

The footbed itself is preferably composed of multiple laminae 18 of a water-activated, plastic-impregnated fabric sheet material. An ideal such material is a casting material sold under various trade names by various well-known manufacturers of medical tapes and supplies. Such material is typically a water-activated, polyurethane-impregnated, open weave, cotton-polyester blend fabric, commonly used as a substitute for plaster of paris in immobilizing injured limbs by the medical profession.

However, such material is also available in a closed weave fabric, which is especially suitable where an extra thick footbed is desired. Fiberglass casting material is also available and suitable for footbed construction, but its greater strength requires use of about one-half the number of laminae of a cotton-polyester blend fabric for the same rigidity.

It is to be understood that "casting material", as used herein, means any open or closed weave fabric sheet material which is impregnated with a bonding and hardening agent but sufficiently flexible in an uncured state as to be capable of conforming to the contours of the sole of a foot. The term "impregnated", as used herein, includes both fabric that is coated and fabric, the interstices in the weaving of which, is filled with the bonding and hardening agent.

The illustrated footbed support is a built up construction, with the laminae of casting fabric bonded together by weight-bearing pressure applied to the impregnated water-activated polyurethane during the curing process. As shown in FIG. 9, the number of laminae in different portions of the footbed vary to provide the variable flexibility, rigidity, or thickness desired. For example, in ski boot applications it is usually desirable to provide a flexible toe portion 10*c*, a very rigid heel portion 10*d*, and a moderately rigid arch portion 10*a*. Using the cotton-polyester casting material previously described it has been found that four laminae provide a very flexible and thin section; five laminae provide good flexibility and are the suggested number for use under the ball of the foot in most ski boot applications. Six to nine laminae provide a range of moderate flexibility to quite rigid support, and would be a suitable number for use anywhere throughout the footbed when desired. Ten laminae provide a very rigid section and are usually the suggested number for use in the heel section of the footbed. Ten laminae are usually the maximum number of laminae suggested for use in footbeds. The open mesh fabric in a five laminae thickness provides a thin profile flexible footbed suitable for boots and shoes requiring a minimum thickness footbed or maximum volume for a proper fit. However, closed mesh laminae provide a thick profile footbed suitable for boots or shoes requiring volume reduction for a good fit or extra rigidity throughout the footbed. The footbed shown in FIG. 9 would be typical for one made of open mesh laminae. It provides five laminae 18 in the fore portion of the footbed for flexibility, eight laminae in the arch portion for moderate rigidity, and ten laminae in the heel portion for great rigidity.

The laminate footbed portion 19 described is preferably covered with a smooth, soft foot-engaging surface layer 20, a portion of which is shown in FIG. 7. If desired, however, the laminate portion 19 of the footbed can remain uncovered, such as in applications where a maximum volume is needed in the shoe or boot, particularly in the toe areas.

Apparatus for Manufacturing Footbed Supports

Referring to FIG. 1, the basic apparatus and materials for manufacturing the described footbed supports includes a tray 22, a domed resilient rubber foot pad 24, rolls of thin, flexible clear plastic sheet material 26, and the aforementioned liquid-activated, plastic-impregnated casting material which, in an uncured state, typically is packaged in sealed foil envelopes and comes in four inch or five inch wide strips thirty inches long.

Tray 22 is divided into two tray sections 22*a* and 22*b* of equal size. Each tray section includes a flat floor 30 enclosed by four sidewalls 32. The two tray sections are slidably interconnected by a pair of slide bars 34 fixed to one tray section 22*a* and slidably connected to the other tray section 22*b* by a bolt extending through a sidewall of the latter tray section and through a slot 36 of slide bar 34. A wing nut 38 provides a locking means for interlocking the two tray sections in selected laterally spaced positions to provide adjustable spacing between such sections when desired, as o indicated by the dashed lines 22*a*' in FIG. 1. If desired, index markings (not shown) can be provided along one edge of adjacent tray walls to facilitate proper spacing.

Tray 22 also includes a pair of mounting arms 40, 41 projecting rearwardly from opposed sidewalls of the two tray sections and supporting a mounting rod 42 therebetween. The rod supports a roll 43 of the clear plastic 26, only one of the rolls being shown.

The foot pad 24 is divided through its domed portion 46 into two half sections 24*a* and 24*b*, each of which fits snugly within one of the two tray sections. Overall the pad comprises the central domed portion 46, the surface of which merges smoothly with surrounding pad portions 48 as will be most apparent from the lateral and longitudinal profiles of the pad sections as shown in FIGS. 10 and 11.

Each pad section is designed to receive one of the two feet of the person for whom a pair of footbed supports is to be made. In FIG. 1, pad section 24*a* receives the right foot and pad section 24*b* the left foot. The two pad sections are mirror images of one another. The adjoining central domed upper surface portions 46 of the two pad sections slope steeply laterally outwardly to the flat surface portion 48 and slope more gently forwardly and rearwardly to the same flat surface portion. Of course, the specific dome configuration can be changed to accommodate different foot sizes, shapes, problems, and foot pads of different degrees of resiliency. In general, the resiliency of the foot pad should be such that the full weight of the foot does not cause full compression or "bottoming out" of the pad material. Conversely, the pad should be sufficiently resilient or compressible as to enable formation of a full foot impression when full foot weight is applied.

The sidewalls 32*a* of the tray sections bordering the domed portions 46 of the foot pads are contoured to the profile of and provide lateral support for the domed portions.

The upper surfaces of the foot pads are also provided with indexing means as aids in properly positioning the feet on such pads. A first such means comprises color coded index stripes 50, 51, 52 extending longitudinally over the domed portions 46 to provide positioning zones as an aid to vertical positioning of the instep longitudinal arch line of a foot on a domed portion. For example, the upper stripe provides a yellow zone and indicates the proper vertical position for the inner margin of the instep/longitudinal arch line of a foot having a very high longitudinal arch or Type I classification as discussed below. The next lower stripe provides a blue zone and indicates the region for positioning the inner margin of the instep/longitudinal arch line of a foot with an average longitudinal arch height or Type II foot classification. The lowest stripe provides a red zone and indicates the region of the dome for proper positioning of the inner margin of a foot with a low longitudinal arch or Type III classification.

A second indexing means comprises a series of pointer-type markers which serve as aids in properly positioning the feet on the pads after the pads are covered with the casting material. These include the ball-of-foot pointers 54, the side pointers 55 and the heel pointers 56. By marking those portions of each foot which line up with the various pointers when the foot is properly positioned on the pad before the casting material covers the pad, the foot can then be placed on the pad in the same position after the pad is covered with such material.

Additional, but conventional, devices usable in carrying out the method of the present invention include a Ped-o-graph, a known device for making an imprint of the sole of the foot and classifying it according to shape and weight bearing characteristics. Another such useful device is a Brannock device for making various foot measurements.

Method Of Manufacturing Footbed Support

A. Foot Examination and Classification

Each footbed support is custom designed and manufactured for a particular foot of the person who will wear the support. The design takes account various foot characteristics, such as size, shape, and structure, which are measured, observed, and used to classify the foot and position it on the foot pad. During the manufacturing process the feet are an integral part of the method. The shoes and socks are removed from the feet. An imprint of the sole of each foot is made on a Ped-o-graph. From this imprint each foot is classified as one of three types. The three types are shown in FIG. 2 and include a Type I characterized by a very high arch, a Type II characterized by an intermediate arch (the most common), and a Type III foot characterized by a low arch, or relatively flat foot. This classification is then used in determining the proper vertical foot position on the domed portion of the foot pad. The imprint also indicates foot areas of high and low pressure so that those foot areas of the foot requiring rigid or flexible support from the footbed can be determined.

The feet are also measured on a Brannock device as part of the preliminary procedure. The measurements include toe length, arch length, and width of the foot in relation to arch length. These measurements are then used to determine proper positioning of the feet longitudinally on the foot pad relative to the domed portion.

The feet are also inspected visually for specific foot characteristics such as pronation or supination, forefoot valgus or varus, and other peculiarities of foot shape or position. The foot inspection should include observation of the foot structure and relationship between the hind, mid and forefoot. Such inspection should also include a weight bearing inspection, a visual inspection of the bottom of the foot, and manipulation of the feet to help determine bone structure and connective tissue laxity or tautness.

Finally, the foot inspection should include examination of the alignment of the hip, knee and ankle to determine the width spacing needed between the domed portions of the foot pad sections. Such width spacing is used to correct for any misalignment of such portions of the anatomy from the vertical, and in the absence of any misalignment to provide a comfortable, balanced stance during the manufacturing process. The desired spacing is achieved through lateral adjustment of the spacing between tray sections.

Certain foot conditions, such as pronation, supination, and forefoot valgus or varus, can be corrected by the footbed support in combination with various wedges placed under the appropriate portion of the foot during the footbed manufacturing process. Such wedges can also be affixed to the bottom surface of the finished footbed support to cause the user to assume a desired neutral position while standing in shoes or boots on the footbed. Foot inspection and manipulation can also reveal the need for any heel lift needed, which can be provided by building up the heel of the footbed or wedging under the heel to provide a more neutral stance, for example, in a ski boot. In addition, the footbed thickness can be controlled or the footbed shimmed to take into account any special foot conditions, leg length differences, injuries to foot or ankle, or any other condition that might affect the flex, thickness or orientation required for the footbed.

From the foregoing imprinting and inspection, each foot is classified as a Type I, II, or III foot, and this classification is used to determine how the foot should be positioned on the footbed.

The yellow zone 50 of the domed portion of the pad receives a Type I foot. Such a foot is generally rigid, has a high longitudinal arch, has little pronation and usually assumes a desired "neutral" position with the person in a natural stance. Such neutral position can be defined as a foot position in which the talus and navicular bones of the foot are aligned. The Type I foot is placed high on the dome, as shown in FIG. 10, to provide a footbed arch configuration that will support this high arched foot. The arched portion of the foot is generally more rigid than the fore and hind portions. The Type I foot is generally very well supported internally and, therefore, a flexible footbed can and should be manufactured for this type of foot. The Type I foot is placed on the foot pad with the inner margin of the foot extending along the yellow zone 50 of the dome. The forefoot and hind foot can be positioned to lie in a common horizontal plane if desired by placing wedges between the pad and foot where needed. The fore and aft placement of the foot in the yellow zone is determined by the longitudinal arch measurement and configuration.

The Type II foot as shown in FIG. 2 is usually a more mobile foot than the Type I, usually has a lower instep/-longitudinal arch line than the Type I, and usually has some pronation and forefoot varus. When in a natural weight-bearing stance, it moves out of the desired neutral position. This type of foot is placed in the blue zone 51 vertically lower on the dome than a Type I foot for comfort, as shown in FIG. 10. A high footbed arch configuration for such a low to medium-arched foot would be too supportive in the non-weight bearing longitudinal arch areas of the foot. The arch of the footbed should be made quite flexible for comfort, while the fore and hind portions of the footbed should be made thicker and more rigid to be more supportive for these generally mobile and usually somewhat structurally weak areas of the foot. The forefoot and hind foot positions can be controlled by wedges if needed to cause the foot to assume a neutral position when weighted on the foot pad.

A Type III foot, as shown in FIG. 2, is generally very mobile, has a very low instep/longitudinal arch line, pronates excessively, has forefoot varus, and moves from a neutral to a flat foot position when weighted, causing the ankle to rotate. The inner margin of the instep/longitudinal arch line of such a foot is placed on the red zone 52 of the foot pad, as shown in FIG. 10. The red zone is the lowest vertical zone on the domes and provides the footbed with a flatter arch configuration than the other zones. The arch portion of the footbed for this type of foot needs to be supportive, but should not have a high or even medium configuration, because this would cause discomfort by concentrating weight on this small, sensitive and weak area of the longitudinal arch. The fore and hind foot areas of the footbed should be made rigid while the arch area should be made fairly flexible and therefore more comfortable for the wearer. Wedging under the hind and forefoot areas may be needed to cause the foot to assume a neutral foot position on the pad.

B. The Footbed Manufacturing Process

As a first step in the manufacturing process, the feet are prepositioned on the domed pads, as shown in FIG. 3, to show the wearer the proper positioning of the feet on the pads according to the appropriate color-coded index stripes. With the feet properly positioned, the alignment of various portions of the feet with the various index pointers 54, 55, and 56 is noted and marked on the feet so that the same position can be assumed later when the pad is covered with the casting material. The proper lateral spacing between tray sections is also set at this time according to preobserved alignment of the hip, knee and ankle to correct for any misalignment of these body parts. If no alignment correction is needed, the spacing between tray sections is set so that the person will assume a comfortable, neutral stance when the feet are properly positioned on the pads. During this step the pads can be covered, if desired, with a sheet of the thin transparent plastic material 26 such as a "Saran Wrap" type of clear plastic, as shown at **26*a* in FIG. 4**, to keep the pads clean.

Next, the feet are removed from the domed pads. With gloves on the hands of the manufacturer for protection, the appropriate number of laminae of casting material is selected. With a casting material such as the aforementioned plastic-impregnated, cotton-polyester fabric 7, it is recommended that a minimum of four laminae be used in constructing the footbed. This will provide a very thin, flexible footbed support. On the other hand, no more than about ten laminae of this type should be used in any area of the footbed. Ten laminae will provide a very rigid support and is a recommended number to use under the heel to hold the heel in proper alignment.

The desired maximum number of laminae is laid on the foot pads over the domes 46. Preferably, one edge of the casting material is laid along the selected dome stripe 50, 51, 52 to determine the inner margin of the footbed. This will minimize trimming later and also provides good visibility of the desired color zone to simplify foot positioning on the dome. At this point, the laminae are trimmed to approximate overall length. Each individual lamina is also cut to length, as required, to provide the desired number of laminae under various portions of the foot, as shown in FIG. 4. For example, typically about four or five laminae are provided under the toe and ball of the foot, five to eight laminae under the longitudinal arch portion of the foot, and eight to ten laminae under the heel portion of the foot. At this point, any accessories, such as metatarsal bars or pads, varus wedges or toe crowns, can be placed on the pads above or below the laminae as needed to control foot problems determined during the inspection and measurement phase of the footbed manufacturing process, and to cause the feet when weighted to assume neutral positions on the pads. Each individual lamina can also be trimmed to width as desired to provide a variable flexibility across the width of any portion of the footbed.

With the casting material trimmed as desired, it is removed from the foot pads and dipped in water to activate it. It is then immediately placed back on the foot pads over the domes in the same position as before and with the longest laminae on top so that those next to the foot will be full length. Next the wet, flexible, but still uncured laminae are covered with a sheet of the plastic 26 from roll 43 as shown at **26*b* in FIG. 4**, to protect the skin of the feet.

Now the feet are placed on the casting material, realigning the premarked portions of each foot with the appropriate indicators 54, 55, and 56, with the inner margin of each foot placed in the proper color zone on the domes. Next the feet are fully weighted to form the impressions and bond the laminae. The feet should assume desired neutral positions either naturally or because of previous wedging. This step is shown in FIG. 5.

The degree of impression needed in the toe area of the footbed is controlled through the use of toe pads or wedges 50 under the toes, as shown at 50 in FIG. 5. Such pads or wedges are placed on the casting material under the toes for the first two minutes of curing time, then removed to allow the toes to grip the resulting impression to form a desired crown 52, as determined during the preliminary inspection and measurement phase of the footbed manufacturing process, as shown in FIGS. 6 and 7. The feet are removed from the footbed material after about six minutes of curing time, when the material has been bonded and taken a permanent set and contains the desired foot impression 53. The footbed material is allowed to cure for an additional ten minutes thereafter.

At this point the laminae of each footbed are bonded together and form a permanent impression of the foot. The footbed material is removed from the foot pads and trimmed about the impression 52 to the dimension of the insole or liner of the wearer's boots or shoes. Wedges, cushions or any other fitting aids can now be affixed to the bottom of the resulting footbed support with suitable adhesive. The edges of the footbed should be taped to prevent any possibility of delamination. Also the now hard-surfaced footbed can be covered with a softer surface material 20 of a relatively incompressible type. However, if maximum volume is needed in the shoe or boot, the laminate footbed can remain uncovered. Any surface imperfections can be removed by grinding. Final adjustment of thickness or flex can also be made by grinding.

Summary Of Method

In summary, the method of manufacturing the footbed support involves (1) preliminary foot measurement, imprinting, inspection, and classification; (2) prepositioning the feet on the foot pad in accordance with the predetermined classification, wedging the feet if required, and marking the feet for later placement over the casting material on the pad; (3) prepositioning the dry laminate casting material on the pad and trimming the laminae to desired lengths and widths to produce the desired flexibility and rigidity in various portions of the finished footbed support; (4) removing the laminae from the foot pads and activating them in water, then replacing them on the pad with the longest laminae on top; (5) covering the laminae with a thin sheet of plastic for foot protection; (6) placing the feet on the pad over the material and plastic cover in their predetermined positions, and fully weighting the feet while allowing the casting material to partially cure and thereby bond the laminae and form impressions of the feet; (7) removing the feet from the pad and permitting the material to complete its cure; and (8) removing the cured laminate casting material from the pad and trimming the material about the foot impressions to fit within the boots or shoes of the wearer, covering the resulting laminate footbeds if desired with a surface material, attaching wedges and fitting aids to the undersides of the footbeds as required, and grinding the footbeds to remove any imperfections and for final flex and thickness adjustment.

Having illustrated and described a preferred embodiment of the footbed support, apparatus and method of our invention, it should be apparent to persons skilled in the art that the same permit of modification without departing from the principles of our invention. We claim as our invention all such modifications as come within the true spirit and scope of the following claims.

We claim:

1. A method of manufacturing a custom footbed support for use in supporting a foot in a shoe or boot comprising:

positioning a lamina of a liquid-activated fabric sheet casting material while in a wet uncured flexible condition over a domed portion of a resilient foot pad;

placing the user's foot on the uncured material with the longitudinal arch of the foot positioned on a side portion of the domed portion of the pad and with the toe and heel portions of the foot overlying the pad, and applying weight to the foot to form a contoured shape corresponding to the undersurface of the foot in the material;

while continuing to apply weight to the foot, allowing the material to at least partially cure, and then removing the foot from the material such that the material retains the foot contoured shape;

removing the substantially cured material from the pad and trimming the shaped material to size about the impression so as to fit within the shoe or boot.

2. The method of claim 1 including positioning multiple laminae of said casting material on the foot pad while in a liquid-activated state, and applying sufficient foot pressure to the material to cause the laminae to bond together and form said contoured shape.

3. The method of claim 1 including covering the wet flexible material with a thin flexible plastic cover sheet before the foot is placed on the material to form the foot contoured shape.

4. The method of claim 2 including prior to liquid activation, prepositioning the uncured laminae material on the pad and trimming the laminae to desired lengths.

5. The method of claim 1 including prior to placement of the foot on the foot pad, making an imprint of the foot and classifying the foot according to characteristics of the imprint including height of the longitudinal arch, and positioning the foot on the foot pad and material in a position corresponding to its classification such that the higher the longitudinal arch of the foot, the higher the longitudinal arch of the foot is positioned on the domed portion of the pad.

6. The method of claim 1 including prior to final foot placement on the material-covered pad, prepositioning the foot on the pad without the material and with the longitudinal arch of the foot overlying a portion of the domed portion of the pad corresponding to the height of the longitudinal arch, and marking portions of the foot aligned with indicators on the pad so that the foot can be replaced on the pad over the material in the same position.

7. The method of claim 2 including adjusting the number of laminae of casting material on the pad underlying different portions of the foot before liquid activation of such material so as to control the rigidity-flexibility of different portions of the footbed support and thickness of the footbed support when cured.

8. The method of claim 7 including placing fewer laminae of the casting material under the fore portion of the foot than under the hind portion so that the cured footbed support has greater rigidity under the heel than under the ball of the foot.

9. The method of claim 1 including grinding the cured footbed support to control the final smoothness, flexibility-rigidity, and thickness in different portions of the footbed support.

10. The method of claim 1 including adjusting the width spacing between the domed portions of the foot pad which receive the two feet.

11. The method of claim 1 including positioning the feet in predetermined neutral positions on the pad while making the impressions so that the footbeds retain the feet in such neutral positions in the shoes or boots.

12. A method of manufacturing a custom footbed support for use in supporting a foot in a shoe or boot comprising:

positioning a lamina of a liquid-activated fabric sheet casting material while in a wet uncured flexible condition on a resilient foot pad;

placing the user's foot on the uncured material and applying weight to the foot to form an impression of the foot in the material;

while continuing to apply weight to the foot, allowing the material to at least partially cure, and then removing the foot from the material such that the material retains the foot impression;

removing the substantially cured material from the pad and trimming the shaped material to size about the impression so as to fit within the shoe or boot.

13. A method of manufacturing a custom footbed support for use in supporting a foot in a shoe or boot comprising:

applying to at least the undersurface of a foot at least one lamina of a liquid-activated thin, nonresilient fabric sheet casting material while in a wet uncured flexible condition;

while against said undersurface, applying pressure over the outwardly facing surface of the material while it is in said uncured flexible condition to cause the material, including both the outwardly facing surface and the opposed foot-contacting surface, to conform to the shape of the undersurface of the foot;

maintaining overall contact pressure between said material and foot to maintain conformity between the material and foot at least until said material has partially cured to a point such that it will retain an impression of the foot, then removing the at least partially cured material from the foot, permitting the material to at least substantially cure, and finally trimming the shaped material to size about the foot impression to fit within the shoe or boot to form a thin substantially rigid footbed support.

14. A custom footbed support for a shoe or boot comprising at least one layer of a cured liquid-activated fabric casting material in thin, nonresilient sheet form bearing on both sides a contoured shape corresponding to the undersurface of a foot of the user made while the material is in a wet flexible uncured state.

15. A footbed support according to claim 12 wherein said support comprises a laminate including multiple laminae of said casting material bonded together through application of foot pressure while said contoured shape is formed.

16. A footbed support according to claim 15 wherein the number of laminae vary in different portions of the footbed support to provide varying degrees of rigidity-flexibility.

17. A footbed support according to claim 16 wherein the number of laminae in the fore portion of the support of the footbed support are fewer in number than in the heel portion of the footbed support.

18. A footbed support according to claim 12 wherein said casting material comprises a liquid-activated, plastic-impregnated fabric sheet.

19. A footbed support according to claim 12 wherein said sheet comprises a cotton-polyester blend fabric.

20. A footbed support according to claim 12 wherein said sheet comprises a fiberglass fabric.

21. A footbed support according to claim 14 wherein said casting material comprises a closed weave fabric sheet.

22. A footbed support according to claim 14 wherein said casting material includes an open weave fabric sheet.

23. A footbed support according to claim 14 wherein said material comprises a water-activated, polyurethane-impregnated fabric sheet.

* * * * *

UNITED STATES PATENT AND TRADEMARK OFFICE

CERTIFICATE OF CORRECTION

PATENT NO. : 4,520,581

DATED : June 4, 1985

INVENTOR(S) : J. Michael Irwin and Jay P. White

It is certified that error appears in the above-identified patent and that said Letters Patent is hereby corrected as shown below:

Column 6, line 54, change "as o indicated" to --as indicated--;

Claim 1, line 24, change "impression" to --contoured shape--;

Claim 15, line 13, change "12" to --14--.

Signed and Sealed this

*First* Day of *October 1985*

[SEAL]

*Attest:*

DONALD J. QUIGG

*Attesting Officer*

*Commissioner of Patents and Trademarks—Designate*